US009107489B1

(12) United States Patent
Wisniewski

(10) Patent No.: US 9,107,489 B1
(45) Date of Patent: Aug. 18, 2015

(54) CARRY-ALL HANDLE

(71) Applicant: Richard Wisniewski, Maspeth, NY (US)

(72) Inventor: Richard Wisniewski, Maspeth, NY (US)

( * ) Notice: Subject to any disclaimer, the term of this patent is extended or adjusted under 35 U.S.C. 154(b) by 0 days.

(21) Appl. No.: 14/571,657

(22) Filed: Dec. 16, 2014

Related U.S. Application Data

(63) Continuation-in-part of application No. 14/264,261, filed on Apr. 29, 2014.

(60) Provisional application No. 61/817,598, filed on Apr. 30, 2013.

(51) Int. Cl.
*A45F 5/00* (2006.01)
*A45F 5/10* (2006.01)

(52) U.S. Cl.
CPC ..... *A45F 5/10* (2013.01); *A45F 2005/1013* (2013.01)

(58) Field of Classification Search
CPC ..... A45J 45/10; A45J 45/077; A45J 45/071; A45F 5/10; A45F 5/1026; A45F 2005/1013; B65D 23/106
See application file for complete search history.

(56) References Cited

U.S. PATENT DOCUMENTS

| | | | | |
|---|---|---|---|---|
| 164,994 | A | 6/1875 | Harrell | |
| 618,333 | A * | 1/1899 | Colteryahn | 294/157 |
| 1,212,190 | A * | 1/1917 | Davis | 294/155 |
| 3,012,809 | A | 12/1961 | Tremaine | |
| 3,923,222 | A * | 12/1975 | Groves | 294/157 |
| 4,127,223 | A * | 11/1978 | Uchin | 294/150 |
| 4,486,043 | A | 12/1984 | Rais | |
| 4,656,566 | A | 4/1987 | Kelley | |
| 4,842,158 | A | 6/1989 | Reyes, Jr. | |
| 4,896,913 | A | 1/1990 | Kennedy | |
| 5,013,074 | A | 5/1991 | Galle | |
| 5,183,169 | A | 2/1993 | Grzych | |
| 5,531,495 | A | 7/1996 | Hohman | |
| 5,580,343 | A | 12/1996 | Cafiero | |
| 6,193,293 | B1 * | 2/2001 | Ybanez | 294/152 |
| 6,543,825 | B1 | 4/2003 | Dragutin | |
| 6,651,838 | B2 | 11/2003 | Bissell | |
| 6,729,665 | B1 | 5/2004 | Posey | |
| 7,311,343 | B2 | 12/2007 | Callebresi | |
| 7,976,088 | B1 * | 7/2011 | Diciolla | 294/154 |

* cited by examiner

*Primary Examiner* — Stephen Vu
(74) *Attorney, Agent, or Firm* — Keith D. Nowak; Carter Ledyard & Milburn LLP

(57) ABSTRACT

A system for manipulating and transporting items of various sizes and shapes comprising a carry-all handle having affixed thereto at least two hook and hook-loop fastened strips of length A, and a plurality of additional hook and loop fastener strips of various lengths which can be connected to the strips of length A so that the carry-all handle can be attached to and manipulate items of various sizes and shapes.

3 Claims, 8 Drawing Sheets

CARRY-ALL HANDLE

PRIORITY AND RELATED APPLICATIONS

The present invention is a continuation-in-part of U.S. patent application Ser. No. 14/264,261, filed Apr. 29, 2014, entitled "Carry-All Handle" which further claims the benefit of U.S. Provisional Patent Application Ser. No. 61/817,598, filed Apr. 30, 2014, the contents of each of which are hereby incorporated by reference.

FIELD OF THE INVENTION

The present invention relates to a system for easily manipulating and transporting items of various sizes and shapes and, in particular, a carry-all handle system which fits in a convenient pocket-sized package, but includes sufficient hook and loop fasteners, along with a handle, to manipulate and transport a wide variety of items having different sizes and shapes.

BACKGROUND OF THE INVENTION

Various devices are known which are used to facilitate the manipulation of awkward-sized items such as two and three liter disposable plastic bottles of the type used to package beverages. Such plastic bottles are large and quite heavy when filled with liquid. Lifting and manipulating such containers is difficult for children, older adults, and others who may have difficulty manipulating awkwardly shaped and/or heavy items due to illness or injury. Such devices are described, for example, in U.S. Pat. Nos. 4,486,043, 4,842,158, 4,896,913, 5,013,074, 5,183,168, 5,580,343, 6,543,825 and 6,651,838.

All of the devices described in the aforementioned U.S. Patents differ in certain aspects, but all are limited for use with large plastic bottles. None of these references describe or claim a carry-all system that can easily be used for the manipulation and/or transport of a wide variety of items having different sizes and shapes.

It is therefore an object of the present invention to provide a carry-all handle system that can easily be used to manipulate and transport a variety of items with different shapes and sizes.

It is a further object of the present invention to provide a carry-all handle system that can be stored in a pocket or purse, and include all the necessary components to manipulate and transport a wide variety of different items.

BRIEF SUMMARY OF THE INVENTION

A system for manipulating and transporting items of various sizes and shapes comprising a carry-all handle having affixed thereto at least two hook and hook-loop fastener strips of length A, and a plurality of additional hook and loop fastener strips of various lengths which can be connected to the strips of length A. Either the strips of length A can be used to secure the handle to the item to be manipulated or transported, or a combination of the strips of length A, connected to one or more of the plurality of additional strips, can be used for both larger or smaller items.

DETAILED DESCRIPTION OF THE INVENTION

Figure 1A:
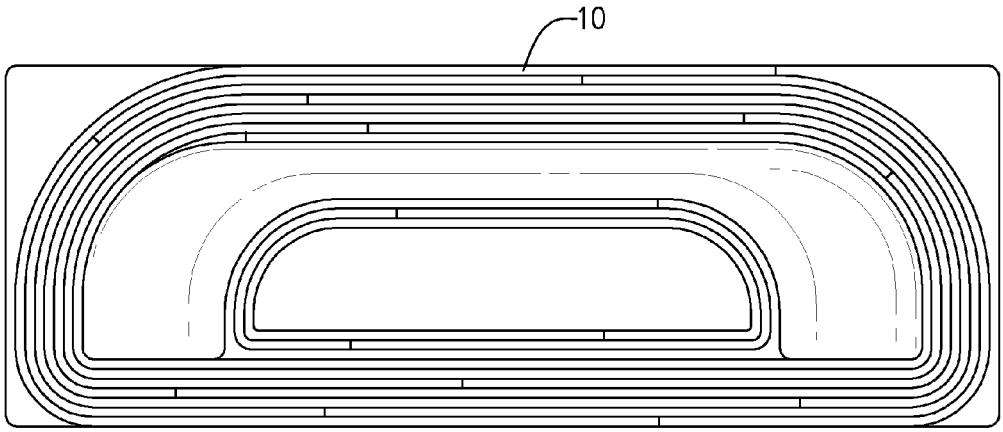
FIGS. 1A and 1B and FIGS. 6A-6C illustrate the carry-all handle system of the present invention.
Figure 1B:
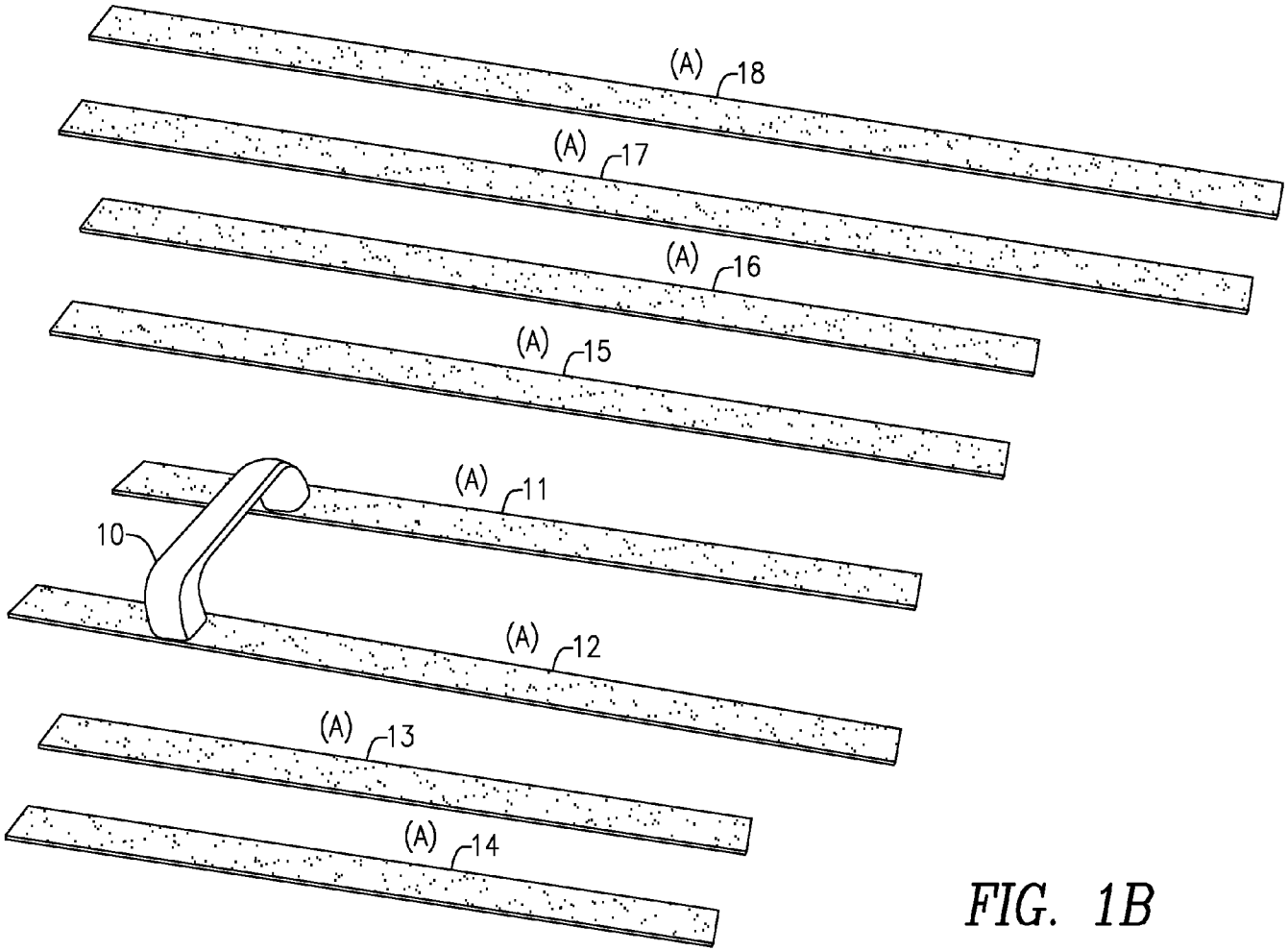

Referring now to FIGS. 1A and 1B, there is shown the components of the carry-all handle system. The primary component is a handle (10) to which is affixed two hook and loop fasteners (11 and 12). The manner in which the fasteners 11 and 12 are connected to handle 10 is described in accordance with FIGS. 6A-6C. Also included as part of the carry-all handle system are additional hook and loop fasteners, such as fasteners 13 and 14, 15 and 16, and 17 and 18.

In order to provide maximum flexibility in manipulating and transporting a variety of items, the hook and loop fasteners should be various lengths. For example, fasteners 11 and 12, which are affixed to handle 10, would typically be 16 inches in length. Fasteners 13 and 14 would be shorter at typically 10 inches in length. Fasteners 15 and 16 would be longer, at 16 inches in length, while fasteners 17 and 18 would be longest, at typically 22 inches in length. It is of course understood that additional or fewer hook and loop fasteners of various lengths could be added to the system for use with the hook and loop fasteners connected to handle 10.

As shown in FIG. 1 A, the handle and all of the fasteners shown in FIG. 1B can be stored in one small box of a size that can be readily carried in a pocket or purse. Therefore a user of the present invention can take the carry-all handle system with him or her while shopping or travelling and have readily available the necessary components to easily manipulate and transport a variety of items having different sizes and shapes.

Figure 2:
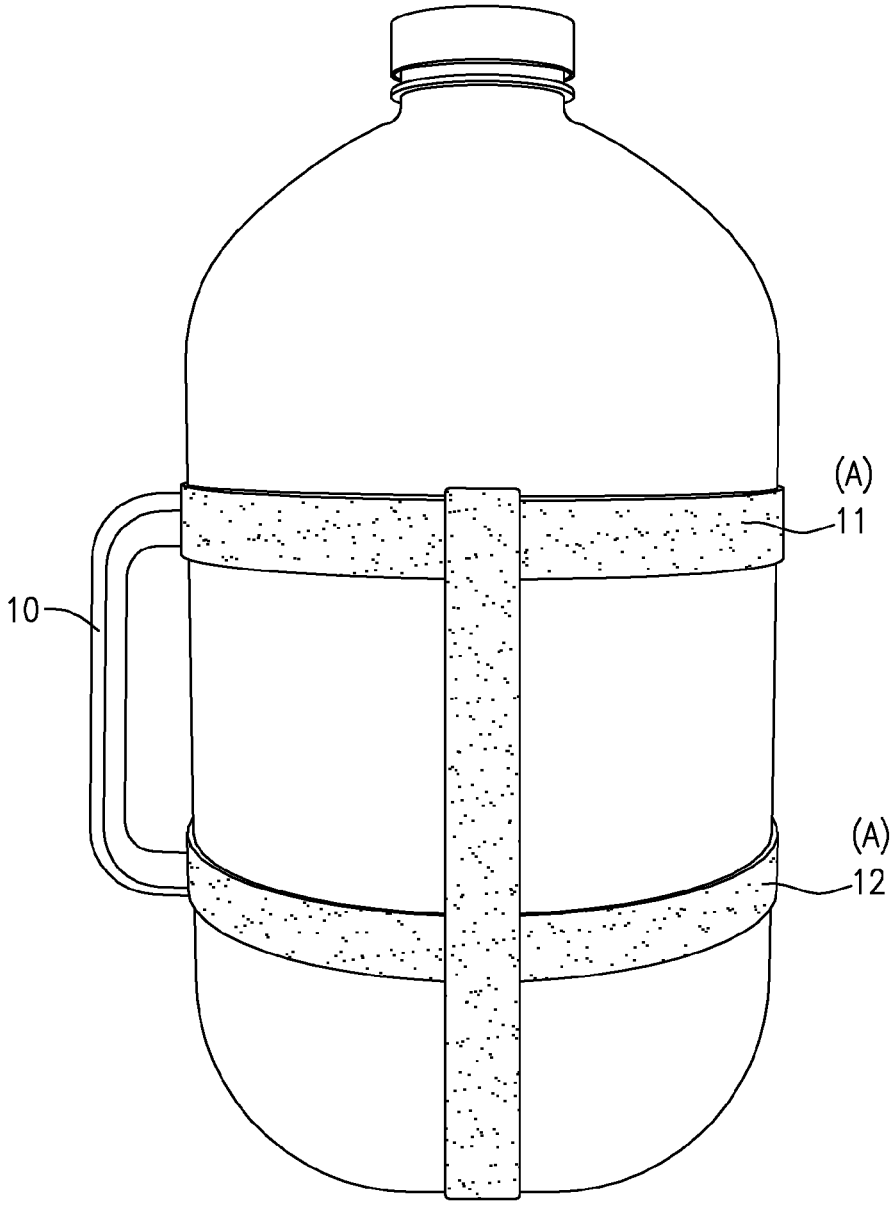
FIGS. 2-5 and FIG. 6D illustrate the various ways in which the invention can be used.

Referring now to FIG. 2, there is shown the use of the carry-all handle system to attach the handle to a large liquid container such as the one used for soft drinks. Fasteners 11 and 12, are affixed to handle 10, and wrapped around the container, while fasteners 13 and fastener 14 (not shown) are placed around the bottom of the container and attached to fasteners 11 and 12. This is one method to provide additional support for a container that may be full of liquid and thus quite heavy. The use of the carry-all handle system allows the container to be manipulated with one hand and to easily pour out liquid from the container without spillage. It is preferred that the loop side of the hook and loop fasteners face the object to which the handle 10 is attached to provide a better grip.

Figure 5:
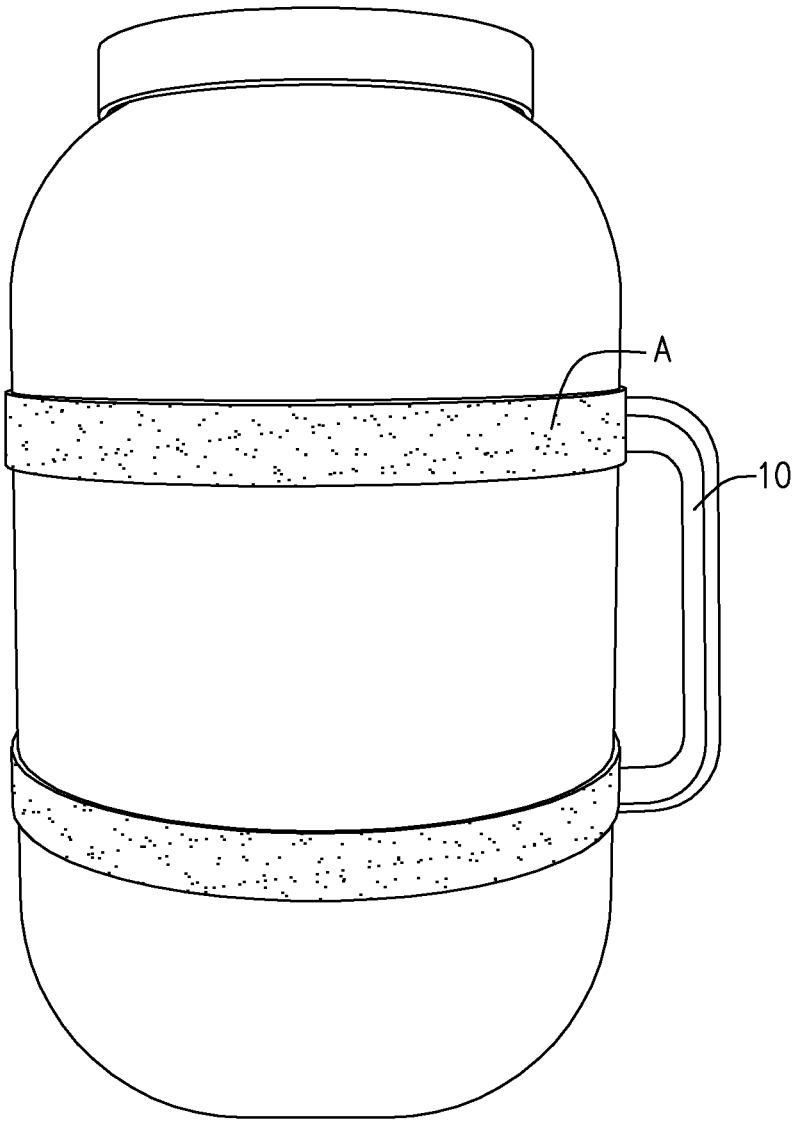

FIG. 5 shows a similar arrangement with a different size and shape container which does not need the additional support of a fastener being placed around the bottom of the container.

Figure 3:
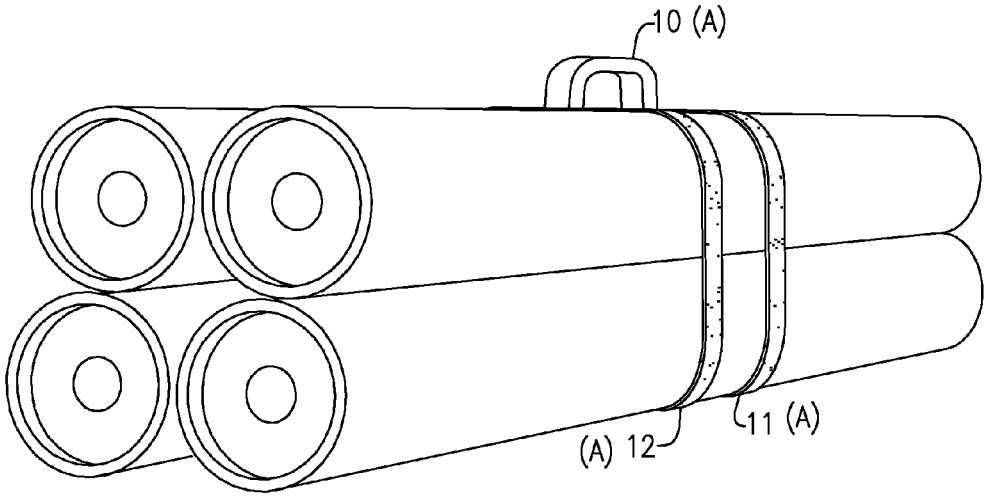

FIG. 3 shows the use of the carry-all handle system to transport a number of cylindrical items which, for example, could be drawings or other items stored in each cylinder. Depending on the size of the cylinder, a user could just use handle 10 and fasteners 11 and 12 to carry the cylinders. However, if the cylinders were large, additional fasteners could be added to fasteners 11 and 12 to accommodate larger items. As the fasteners are all hook and loop strips, the fasteners can easily be connected to each other by simply overlapping the ends of the respective fasteners. For light items, a 1 inch overlap is suggested and a 2 inch overlap for heavier items. In this way, the carry-all handle system can easily transport awkward shaped items of various sizes such as cylinders, without difficulty.

Figure 4:
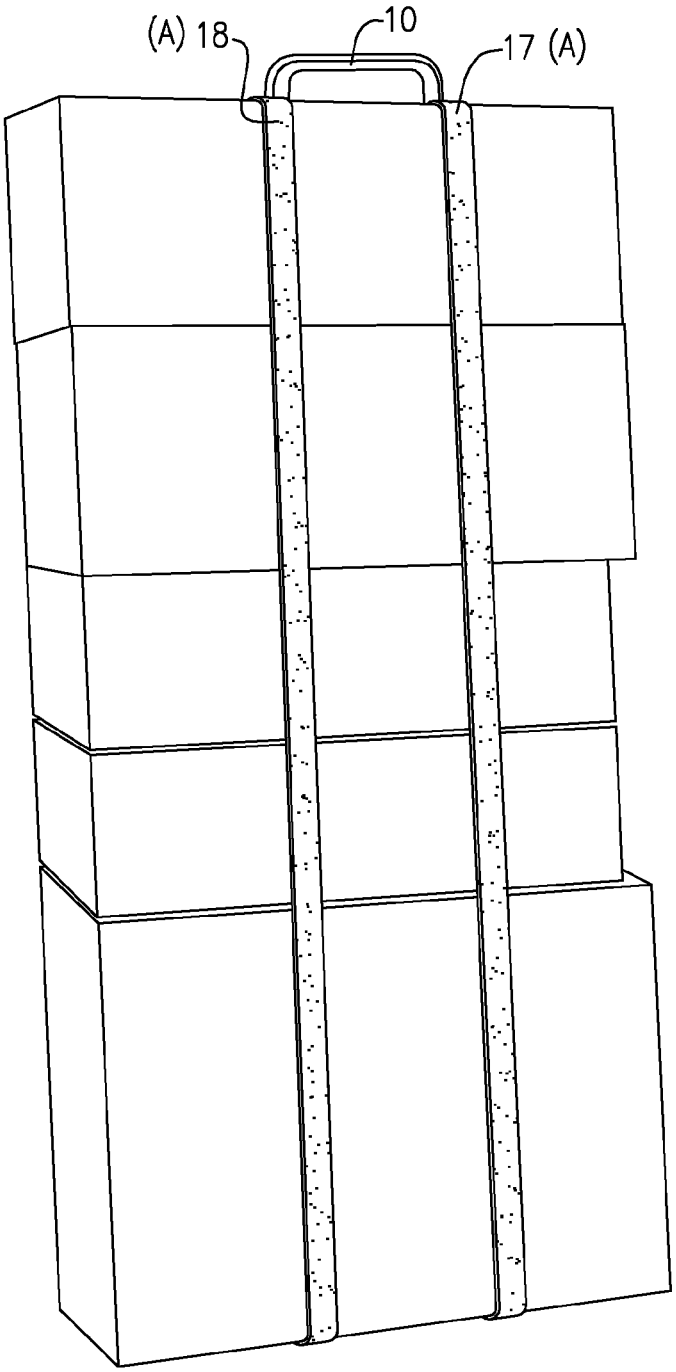

FIG. 4 shows the use of the carry-all handle system to transport a number of boxes of different sizes. For this application, a number of hook and loop fasteners, included with the carry-all handle system, would have to be connected together in the manner described above. In this way, the system allows a shopper, for example, to easily transport a plurality of purchases that would not fit in the type of bags normally provided by a retail establishment.

Figure 6A:
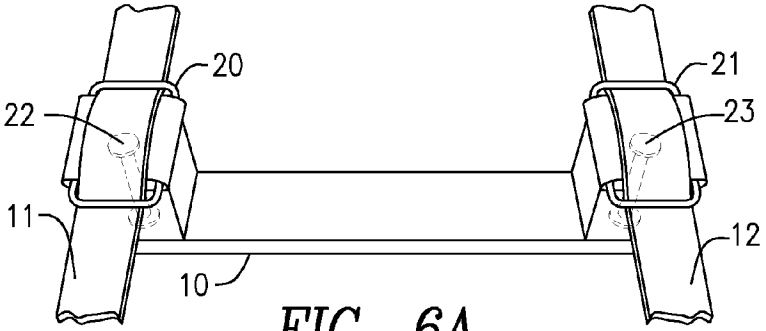
Figure 6B:
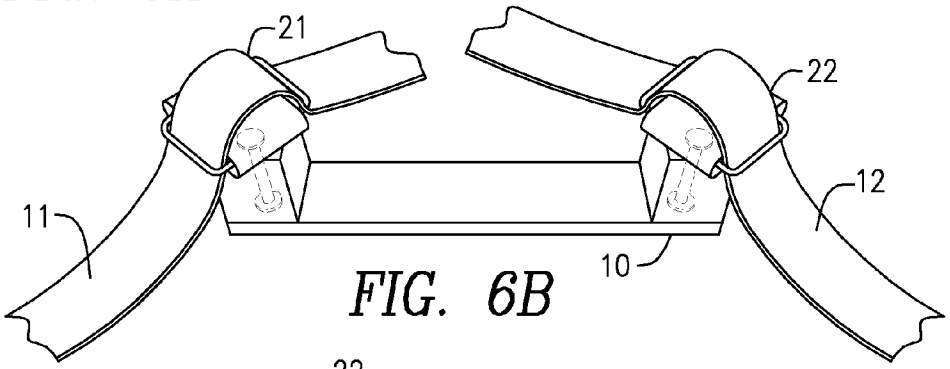
Figure 6C:
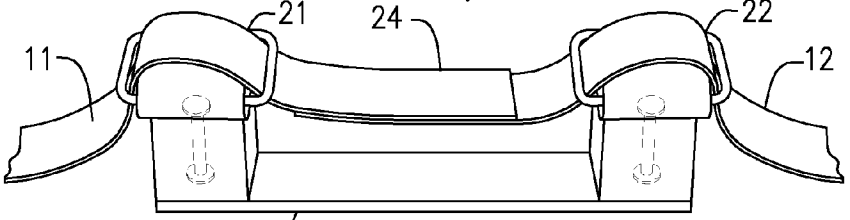

Referring now to FIGS. 6A-6C fasteners 11 and 12 are connected to handle 10 with connectors 21 and 22.

FIG. 6A shows how fasteners 11 and 12 are connected to handle 10 when connectors 20 and 21 are perpendicular to the length-wise portion of handle 10. In this configuration, the carry-all handle of the invention described herein, is used in accordance with the embodiments shown in FIGS. 2-5.

Figure 6D:
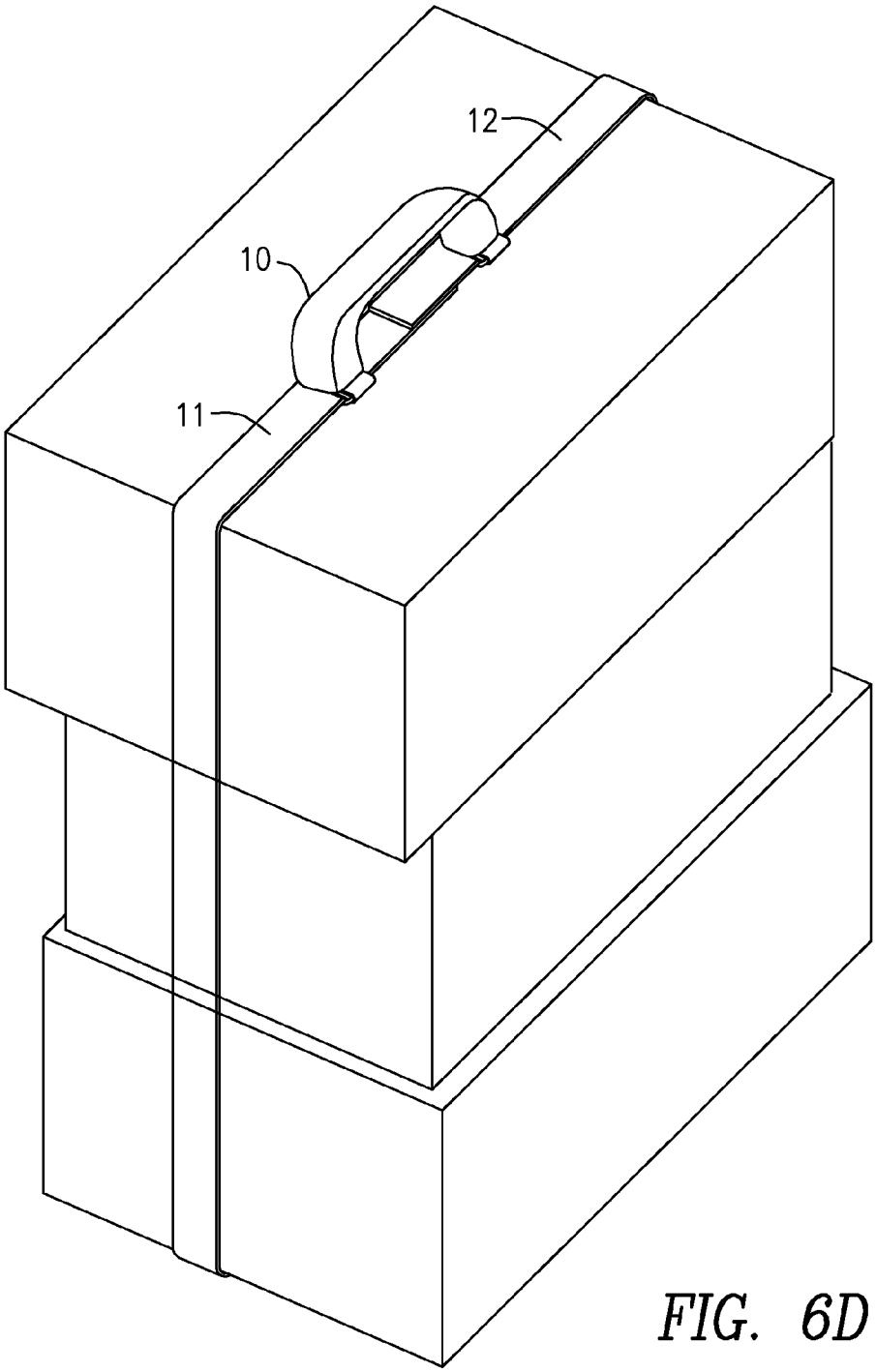

FIG. 6B shows connectors 21 and 22 being rotated to the position shown in FIG. 6C where connectors 21 and 22 are parallel to the lengthwise portion of handle 10. In this configuration fasteners 11 and 12 are overlapped at 24 so that fasteners 11 and 12 can now be used as a fastener of up to twice the length of the fasteners 11 and 12. In this configuration, the carry-all handle of the invention is used in accordance with the embodiment shown in FIG. 6D.

The foregoing is illustrative only of the principles of the invention. Since modifications and changes will readily occur to those skilled in the art, the invention is not limited to the exact construction and operation shown and described, but covers all equivalents falling within the scope of the following claims.

The invention claimed is:

1. A multi-component system for manipulating and transporting items of various sizes and shapes, the system comprising:

a handle having a first end and a second end, at least one connector rotably connected to the first end and the second end of the handle, wherein each of said connectors capable of being rotated 90° from a first position to a second position, and at least one strip of hook and loop fastener of a first length with a first end and a second end, removably attached to each of said connectors so that when each of said connectors is in the first position the two strips of hook and loop fastener having the first length can be used to manipulate and transport an item, and when each of said connectors is in the second position the two strips of hook and loop fastener can be connected together at said first end of each of said hook and loop fasteners to form a length of hook and loop fastener approximately twice the length of said first length and can be used when connected together to manipulate and transport an item;

wherein a plurality of additional strips of hook and loop fastener material can be connected to the length of at least said two strips of said hook and fasteners by overlapping the strips of hook and loop fastener material wherein the strips of hook and loop fastener material are used to secure the handle to the item to be manipulated or transported by using only the strips of the length or using a combination of the strips of the length connected to one or more of the plurality of additional strips of hook and loop fastener material; and a plurality of additional strips of hook and loop fastener material with a first subset of the plurality of said strips of hook and loop fastener material having a length greater than the length of at least said two strips of said hook and fasteners and a second subset having a length less than the length of at least said two strips of said hook and fasteners, wherein the strips of hook and loop fastener material are used to secure the handle to the item to be manipulated or transported by using only the strips of the length of at least said two strips of said hook and fasteners or a combination of the strips of the first subset connected to the strips of the length of at least said two strips of said hook and fasteners for larger items and the strips of the second subset connected to the strips of the length of at least said two strips of said hook and fasteners for smaller items.

2. The multi-component system in accordance with claim 1 wherein the components of the system are able to fit within a container capable of being carried within a user's pocket or purse.

3. The multi-component system in accordance with claim 1 including at least one additional strip of hook and loop fastener material, said additional strip intersecting with said first strips and being positioned around a bottom of the item.

* * * * *